US006173513B1

(12) United States Patent
Akimoto

(10) Patent No.: US 6,173,513 B1
(45) Date of Patent: Jan. 16, 2001

(54) WHEEL LOADER

(75) Inventor: Takao Akimoto, Iruma (JP)

(73) Assignee: Komatsu Ltd., Tokyo (JP)

( * ) Notice: Under 35 U.S.C. 154(b), the term of this patent shall be extended for 0 days.

(21) Appl. No.: 09/211,477

(22) Filed: Dec. 14, 1998

(30) Foreign Application Priority Data

Dec. 17, 1997 (JP) ..... 9-364648

(51) Int. Cl.[7] ..... E02F 3/64
(52) U.S. Cl. ..... 37/414; 37/902
(58) Field of Search ..... 37/348, 382, 414, 37/902; 60/445

(56) References Cited

U.S. PATENT DOCUMENTS

| | | | | |
|---|---|---|---|---|
| 4,022,023 | * | 5/1977 | Inaba et al. | 60/445 |
| 4,464,898 | * | 8/1984 | Aoyagi et al. | 60/436 |
| 4,726,186 | * | 2/1988 | Tatsumi et al. | 60/434 |
| 4,800,660 | * | 1/1989 | Masao | 37/414 |
| 5,050,379 | * | 9/1991 | Nagai et al. | 60/368 |
| 5,434,785 | * | 7/1995 | Myeong-hiin et al. | 364/424.07 |
| 5,899,008 | * | 5/1999 | Cobo et al. | 37/348 |
| 5,907,952 | * | 6/1999 | Akasaka et al. | 60/452 |

FOREIGN PATENT DOCUMENTS 3-107587 5/1991 (JP) .

* cited by examiner

*Primary Examiner*—Thomas B. Will
*Assistant Examiner*—Meredith C. Petravick
(74) *Attorney, Agent, or Firm*—Sidley & Austin

(57) ABSTRACT

A wheel loader, having a higher acceleration and an energy-saving performance, as well as a higher traveling and working efficiency, includes: a traveling system, having an engine (1) as a driving power source; and a hydraulic working system, operated by receiving pressurized oil from a hydraulic pump (81, 82) having the engine (1) as a driving power source. The hydraulic pump can be a variable displacement hydraulic pump (81) or the combination of a fixed displacement pump (82) and an unloader valve (821). The displacement volume (V) of the variable displacement hydraulic pump (81) can be changed from a maximum (Vmax) to a minimum (Vmin) when the hydraulic working system is changed to be in a neutral (non-operating) condition (Wo). The useful output of the hydraulic pump (81,82) can be changed from a maximum (Vmax) to a minimum (Vmin) when a vehicle speed is greater than a specified vehicle speed, or the speed gear is changed from a low side speed gear to a high side speed gear.

11 Claims, 3 Drawing Sheets

WHEEL LOADER

TECHNICAL FIELD

The present invention relates to a wheel loader by which a higher acceleration, an energy-saving performance, and a higher traveling and working efficiency can be obtained.

BACKGROUND ART

A wheel loader has a traveling system and a hydraulic oil working system. The traveling system is driven by an engine, and the hydraulic oil working system is operated by receiving pressurized oil from a hydraulic pump which is driven by the engine. The engine of a wheel loader is set so that the maximum torque Te of the engine at each engine speed somewhat exceeds the total absorption torque (Th+Tr), which is obtained by adding the full absorption torque Th of the hydraulic working system to the absorption torque Tr of the traveling system at each engine speed in a low-to-medium engine speed range (Te>Th+Tr). A difference $\Delta T[=Te-(Th+Tr)]$ between the maximum torque Te of the engine and the total absorption torque (Th+Tr) is set as excess torque $\Delta T$ (hereinafter, called excess torque $\Delta T$).

The excess torque $\Delta T$ ensures an acceleration to abruptly increase the engine speed from the low-to-medium engine speed range (specifically, a low-to-medium engine horsepower range) to a high engine speed range (specifically, a high engine horsepower range) in response to a hard increase in the pressure on the accelerator pedal provided adjacent a driver seat. The acceleration performance becomes higher as the excess torque $\Delta T$ is greater. The traveling system has a speed change lever, with a plurality of speed change positions, located adjacent to the driver seat. The speed of the wheel loader is freely changed among a neutral (stopping) position, a forward position, and a reversing position, and among respective speed positions in the forward and reversing positions by the operator manipulating the speed change lever. In most cases, the hydraulic pump is a fixed displacement type, but a variable displacement type is used in some cases. A more specific explanation follows.

As is shown in FIG. 3, the wheel loader comprises a vehicle body A and a working machine B, which is located at the front portion of the vehicle body A. The working machine B includes a pair of arms B2 and a bucket B4. The base (rear) end of each arm B2 is pivotably attached to the front portion of the vehicle body A by a respective pivot pin, so that the bucket B4 can be freely raised and lowered by a pair of arm hydraulic cylinders B1, each of which is connected between the vehicle body A and an intermediate portion of a respective one of the pair of arms B2. The distal (foremost) ends of the pair of arms B2 are pivotably attached by respective pivot pins to the lower backside of the bucket B4, so that the bucket B4 can be freely pivoted between a backwardly tilted position and a dump position by the bucket hydraulic cylinder B3, one end of which is connected to the vehicle body A and the other end of which is connected through a linkage to the backside of the bucket B4 at a location above the pivot pins for the connection of the arms B2 to the bucket B4.

The vehicle body A also includes a traveling system comprised of: a driver seat A1; an engine (not illustrated); a torque converter (not illustrated); a transmission (not illustrated); a drive shaft (not illustrated); a differential (not illustrated); four tires A2 located at the right front, left front, right rear, and left rear of the vehicle body; a speed change lever (not illustrated); and the like. The vehicle body A further comprises a hydraulic working system which includes: a hydraulic oil circuit, having a hydraulic pump and which makes the hydraulic cylinders B1 and B3 extendable; the working machine B; a working machine operating lever (not illustrated), which is provided adjacent to the driver seat A1; and the like. The engine speed is controlled in response to the depression angle of an accelerator pedal (not illustrated). The traveling system can also include, for example, a steering hydraulic oil circuit, and the like. Further, various kinds of traveling systems can be used, for example, a system with the torque converter replaced by a damper mechanism, a system with the above mechanical traveling system replaced by a full hydraulic type, an electric type, or the like.

The wheel loader, constructed as described above, carries out a sole traveling operation, a sole working operation, and a joint operation which is a combination of the traveling operation and the working operation.

(1) The sole traveling operation is based on the operation of the speed change lever, the accelerator pedal, and the like, without operating the hydraulic working system (specifically, the working machine operating lever is in its neutral position). The sole traveling operation is conducted, for example, while traveling on a pavement, traveling between two sites, traveling a medium distance or a long distance with a load on the bucket B4 (so-called, load-and-carry), or the like.

(2) The sole working operation is based on the operation of the working machine operating lever, the accelerator pedal, or the like, without operating the traveling system (specifically, the speed change lever is in its neutral position, and a brake pedal is operated). The sole working operation is conducted, for example, when raking and excavating natural ground with the bucket B4 while the loader is in a non-traveling (stopped) condition.

(3) The combined operation is based on the simultaneous operations of the working machine operating lever, the speed change lever, the accelerator pedal, etc. For example, the vehicle body A is moved forwardly, the blade edge of the bucket B4 is thrust into natural ground, and then while the working machine lever is being operated, the accelerator pedal is fully depressed. Thus, the purposes of the combined operations include obtaining a resultant force (a vector) of a greater thrusting force and raking force, produced by hydraulic oil pressure, and excavating with strong power at a higher speed, by increasing the discharge quantity of the hydraulic pump.

In the wheel loader conducting the above combined operations, with the speed change operation being by means of the speed change lever, and the oil quantity adjusting operation being by means of the working machine operating lever, the operator depresses the accelerator pedal hard. As for the operation of a wheel loader having an inching pedal or the like, an operation of depressing the inching pedal or the like can be also included. On the other hand, when an excavating force or a traveling force with smaller strength at a lower speed is desired, the operator only slightly depresses the accelerator pedal. Specifically, the operation mainly consists of a simple operation of obtaining engine horsepower corresponding to the load, in accordance with the depression angle of the accelerator pedal.

However, unless the engine horsepower quickly changes in response to an increase in the pressure on the accelerator pedal, excavation and travel with a high efficiency cannot be achieved. Especially in a wheel loader, a depressing operation to abruptly shift the engine speed from a low-to-medium engine speed range to a high engine speed range is frequently carried out by abruptly depressing the accelerator pedal. For example, in the combined operations described supra, when the vehicle body A is moved forwardly and the edge of the blade of the bucket B4 is thrust into natural ground, some vehicle speed is sufficient until the moment at which it is thrust. Specifically, if there is vehicle speed to some extent, it is not necessary to depress the accelerator pedal so hard, that is, it is suitable if the engine speed is in a low-to-medium speed range.

However, when excavation with strong power at a higher speed is to be conducted next by abruptly and fully depressing the accelerator pedal while manipulating the working machine lever, the acceleration performance of the engine is decreased if there is no excess torque ΔT. Specifically, the engine horsepower does not change quickly in response to a change in the pressure on the accelerator pedal, and a combined operation with a high efficiency cannot be achieved. Accordingly, as for the engine of the wheel loader, it is important to secure the excess torque ΔT in a low-to-medium engine speed range.

Japanese Laid-open Patent No. 3-107587 discloses a prior art system of automatically changing the displacement volume of a hydraulic pump in proportion to the engine speed by using a variable displacement type of hydraulic pump, thereby matching the engine torque with the consumption torque (=hydraulic pump absorption torque+torque converter absorption torque) to obtain an energy saving.

However, as the system disclosed in Japanese Laid-open Patent No. 3-107587 automatically changes the displacement volume of the hydraulic pump in proportion to the engine speed, it has nothing to do with acceleration performance. Making it easier to understand, it is an art of automatically changing the displacement volume of the hydraulic pump in proportion to the engine speed when the engine speed is changed, regardless of the acceleration performance. More specifically, according to the "Detailed Description" section and the FIG. 3 in Japanese Laid-open Patent No. 3-107587, the total absorption torque of the fixed pump and the variable pump in the hydraulic working system side and the torque converter of the traveling system side in a low-to-medium engine speed range greatly exceeds the engine torque, and the excess torque even has a negative value. Thus, the system disclosed in the Japanese Laid-open Patent No. 3-107587 has nothing to do with the acceleration performance of the wheel loader.

On the other hand, it is impossible to obtain an acceleration and an energy-saving performance exceeding those in the prior art from a simple operation of obtaining the engine horsepower corresponding to the load, based on the depression angle of the accelerator pedal, which is an ordinary operation of the prior art.

SUMMARY OF THE INVENTION

Mitigating the disadvantages of aforesaid prior art, an object of the present invention is to provide a wheel loader in which a higher acceleration and an energy-saving performance, as well as a higher traveling and working efficiency, can be obtained.

In a first configuration of a wheel loader according to the present invention, the wheel loader includes: a traveling system, having an engine as a driving power source; and a hydraulic working system, operated by receiving pressurized oil from a variable displacement hydraulic pump having the engine as the driving power source; and control means for promptly controlling the variable displacement of the hydraulic pump to be at a minimum upon said hydraulic working system being changed to be in a neutral condition. The control means can control the displacement volume of the variable displacement hydraulic pump so that it is a maximum when the hydraulic working system is in an operating condition and is promptly changed from its maximum to its minimum when the hydraulic working system is changed to a neutral (non-operating) condition.

According to the first configuration, the following operational effects are obtained. If the displacement volume of the variable displacement hydraulic pump were to be at its maximum side when the hydraulic working system is in a neutral (non-operating) condition, the discharge oil from the variable displacement hydraulic pump would be drained into the sump tank, thereby causing a great drain loss and a pump loss. However, according to the first configuration, when the hydraulic working system is changed to a neutral (non-operating) condition, the displacement volume of the variable displacement hydraulic pump is promptly changed from its maximum side to its minimum side. Consequently, the drain loss and the pump loss can be reduced, thereby achieving an energy-saving. The same thing happens in a range from a low-to-medium engine speed to a high engine speed of the engine; therefore, the excess torque is increased in a low-to-medium engine speed range, and the acceleration performance is increased abruptly from a low-to-medium engine speed range to a high engine speed range during traveling. The displacement volume of the variable displacement hydraulic pump is switched by an on-off step, unlike the prior art in which it gradually changes between the maximum side and the minimum side. For this reason, when the operation of the hydraulic working system is initiated, the displacement volume is switched from the minimum side to the maximum side. On the other hand, when the hydraulic working system stops operating, the displacement volume is switched from the maximum side to the minimum side as soon as the hydraulic working system operation is stopped. Specifically, an extremely quick responsiveness is obtained. Consequently, the wheel loader provides a higher acceleration and an energy-saving performance as well as a higher traveling and working efficiency.

In a second configuration of the wheel loader according to the present invention, the wheel loader includes: a traveling system, having an engine as a driving power source with a plurality of speed gears, ranging from a lower vehicle speed to a higher vehicle speed and being freely and selectively useable; and a hydraulic working system, operated by receiving pressurized oil from a variable displacement hydraulic pump having the engine as a driving power source; characterized by a speed gear detecting means for detecting the one speed gear which is being used, and a control means for inputting a detected speed gear signal from the speed gear detecting means, and for controlling the variable displacement hydraulic pump so that the displacement volume is increased to the maximum side when the detected speed gear is a lower side speed gear, and the displacement volume is promptly reduced to the minimum side when the detected speed gear is a higher side speed gear.

According to the second configuration, the following operational effect is obtained. When the speed gear signal represents a forward first position or a reverse first position, the wheel loader is involved, in most cases, in the combined operations. Accordingly, this can be defined as a "lower side speed gear". On the other hand, when the speed gear signal represents one of the forward positions with a higher speed than that of the forward second position, or a reverse position with a higher speed than that of the reverse second position, the wheel loader is involved, in most cases, in the sole traveling operation. Accordingly, this can be defined as a "higher side speed gear". Specifically, according to the second configuration, when the speed gear is a lower side speed gear, it is assumed that the wheel loader is involved in the combined operation; therefore, the displacement volume of the variable displacement hydraulic pump is increased to the maximum side, thereby enabling the excavating operation with a high efficiency. On the other hand, when the speed gear is a higher side speed gear, it is assumed that the wheel loader is involved in the sole traveling operation; therefore, the displacement volume of the variable displacement hydraulic pump is reduced to the minimum side, thereby reducing the drain loss and the pump loss. Specifically, according to the second configuration, the wheel loader can also provide a higher acceleration and an energy-saving performance as well as a higher traveling and working efficiency, as in the first configuration.

In a third configuration of the wheel loader according to the present invention, the wheel loader includes: a traveling system, having an engine as a driving power source; and a hydraulic working system, operated by receiving pressurized oil from a variable displacement hydraulic pump having the engine as a driving power source; characterized by including a vehicle speed detector for detecting the vehicle speed, and further characterized by a control means which inputs a detected vehicle speed signal from the vehicle speed detector and controls the variable displacement hydraulic pump so that the displacement volume is increased to the maximum side when the detected vehicle speed is less than a specified vehicle speed, and the displacement volume is reduced to the minimum side when the detected vehicle speed is not less than the specified vehicle speed.

According to the third configuration, the following operational effect is obtained. When the vehicle speed is, for example, less than 8 km/h, the wheel loader is involved, in most cases, in the combined operations or the sole working operation. On the other hand, when the vehicle speed is equal to or greater than 8 km/h, the wheel loader is involved, in most cases, in the sole traveling operation. Accordingly, in the third configuration, the speed of 8 km/h, for example, can be defined as the specified vehicle speed. According to the third configuration, when the vehicle speed is less than the specified vehicle speed, it can be assumed that the wheel loader is involved in the combined operations or the sole working operation; therefore, the displacement volume of the variable displacement hydraulic pump is increased to the maximum side, thereby enabling a highly efficient excavating operation. On the other hand, when the vehicle speed is not less than the specified speed, it can be assumed that the wheel loader is involved in the sole traveling operation; therefore, the displacement volume of the variable displacement hydraulic pump is reduced to the minimum side, thereby reducing the drain loss and the pump loss. Specifically, according to the third configuration, the wheel loader can provide a higher acceleration and an energy-saving performance as well as a higher traveling and working efficiency, as in the second configuration.

In a fourth configuration of the wheel loader according to the present invention, the wheel loader includes: a traveling system, having an engine as a driving power source, with a plurality of speed gears, ranging from a lower vehicle speed to a higher vehicle speed, being freely and selectively useable; and a hydraulic working system, operated by receiving pressurized oil from a fixed displacement hydraulic pump having the engine as a driving power source; characterized by including a speed gear detecting means for detecting a speed gear which is being used, an unloader valve, and a control means which inputs a detected speed gear signal from the speed gear detecting means and controls the unloader valve to drain pressurized oil from the fixed displacement hydraulic pump into a sump tank when said detected speed gear is a higher side speed gear.

In the fourth configuration, the variable displacement hydraulic pump in the second configuration is replaced by a fixed displacement hydraulic pump, and the servo mechanism of the variable displacement hydraulic pump is replaced by the unloader valve. Specifically, the operational effects of the entire configuration, except for the unloading function with the unloader valve, are the same as in the second configuration.

In a fifth configuration of the wheel loader according to the present invention, the wheel loader includes: a traveling system, having an engine as a driving power source; and a hydraulic working system, operated by receiving pressurized oil from a fixed displacement hydraulic pump having the engine as a driving power source; characterized by including a vehicle speed detector for detecting vehicle speed, an unloader valve, and a control means which inputs a detected vehicle speed signal from the vehicle speed detector and controls the unloader valve to drain pressurized oil from the fixed displacement hydraulic pump into a tank when the detected vehicle speed is not less than a specified speed.

In the fifth configuration, the variable displacement hydraulic pump in the third configuration is replaced by the fixed displacement hydraulic pump, and the servo mechanism of the variable displacement hydraulic pump is replaced by the unloader valve. Specifically, the operational effects of the entire configuration, except for the unloading function with the unloader valve, are the same as in the third configuration.

BEST MODE FOR CARRYING OUT THE INVENTION

First and second embodiments of a wheel loader according to the present invention will now be explained with reference to FIGS. 1 and 2. The external appearance of the wheel loader is the same as that in FIG. 3. In the following embodiments, a traveling system includes a steering hydraulic oil circuit and the like as in the traveling system explained supra with reference to FIG. 3. As described above, it is suitable if a torque converter is replaced by a damper mechanism, or if a mechanical traveling system is replaced by a full hydraulic type, an electrical type, or the like.

Figure 1:
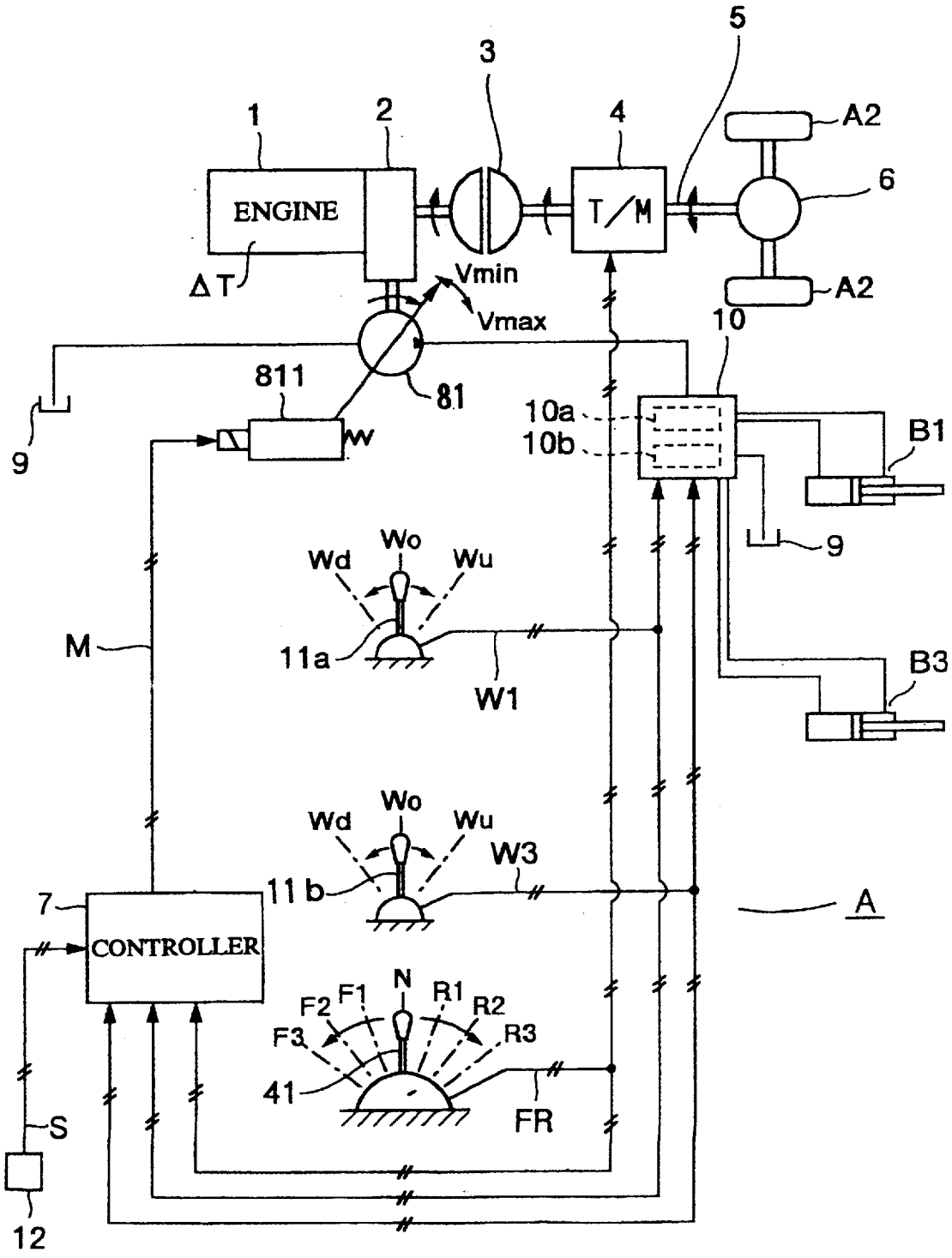
FIG. 1 is a control block diagram according to a first embodiment of the present invention.

A wheel loader in the first embodiment has a power train in which an engine 1; a PTO (Power Take Off) 2, for taking the engine rotating force outside; a torque converter 3; a transmission 4; a drive shaft 5; a differential 6; and four tires A2, located at the right front, left front, right rear, and left rear of the wheel loader; are coupled in that order, as shown in FIG. 1. The transmission 4 has a plurality of speed gears, including a neutral N, three forward gears F1 to F3, and three rearward gears R1 to R3; and by the transmission 4 receiving an electrical speed gear signal FR from the speed change lever 41, the traveling speed of the wheel loader is freely changed. The speed change lever (a speed gear detecting means) 41 has speed gear positions N, F1 to F3, and R1 to R3, corresponding to the gears of the transmission 4, and the speed change lever can be freely moved among the speed change positions by an operator.

At this time, one of a speed gear signal N, corresponding to the speed change lever being in the neutral position N; a speed gear signal F1, corresponding to the speed change lever being in the forward first gear position F1; a speed gear signal F2, corresponding to the speed change lever being in the forward second gear position F2; a speed gear signal F3, corresponding to the speed change lever being in the forward third gear position F3; a speed gear signal R1, corresponding to the speed change lever being in the reverse first gear position R1; a speed gear signal R2, corresponding to the speed change lever being in the reverse second gear position R2; and a speed gear signal R3, corresponding to the speed change lever being in the reverse third gear position R3, is inputted into the transmission 4 and into the controller 7. Here, the speed gear signals N, F1 to F3, and R1 to R3 are the electrical speed gear signals FR. The range of the vehicle speed S of the wheel loader for each of the speed gears F1 to F3 and R1 to R3 can be, for example, "O to 10 km/h" in "F1 and R1", "O to 20 km/h" in "F2 and R2", and "O to 35 km/h" in "F3 and R3".

A variable displacement hydraulic pump 81, as well as the torque converter 3, is mounted to the PTO 2. The variable displacement hydraulic pump 81 is driven by the engine 1, draws working oil from a tank 9, and supplies pressurized working oil into the arm hydraulic cylinders B1 and the bucket hydraulic cylinder B3 via a hydraulic operational valve 10. The variable displacement hydraulic pump 81 has a solenoid servo mechanism 811 (hereinafter called a servo mechanism 811), and by operating the servo mechanism 811, the displacement volume V is freely changed to either a maximum side Vmax or a minimum side Vmin. The minimum side Vmin represents the oil quantity which is just enough to fill the inside of the hydraulic operation valve 10 and does not cause a lubricant shortage or the like.

The hydraulic operation valve 10 is composed of an arm directional changeover valve 10*a*, for extending and contracting the arm hydraulic cylinders B1; a bucket directional changeover valve 10*b*, for extending and contracting the bucket hydraulic cylinder B3; a main relief valve (not illustrated), for regulating the maximum circuit pressure (for example, 250 kg/cm$^2$); and the like. The arm directional changeover valve 10*a* receives an electrical operation signal W1 from an arm operation lever 11*a*, while the bucket directional changeover valve 10*b* receives an electrical operation signal W3 from a bucket operation lever 11*b*. If the operation signal W1 or W3 is "Wo", the position is "the neutral position", if W1 or W3 is "Wd", the position is "an extending position", and if W1 or W3 is "Wu", the position is "a contracting position". Thus, each of the hydraulic cylinders B1 and B3 can be individually held, extended, or contracted. The signals W1 and W3 (specifically, Wo, Wd, and Wu) are also inputted into the controller 7.

A vehicle speed detector 12 is attached to the vehicle body A, and a detected vehicle speed signal S is inputted into the controller 7. The vehicle speed detector 12 can be anyone of various kinds of detectors, for example, a detector equipped with a radar system configuration, such as a sound wave, a laser beam, an infrared ray, a millimeter wave, and the like, which calculates the vehicle speed S based on the Doppler effect or the like; a detector which calculates the vehicle speed S from information received from the GPS or the like; a detector which calculates the vehicle speed S from the rotational frequencies of the drive shaft 5 or the like. The accuracy of the calculation of the vehicle speed S based on the rotational frequencies of the drive shaft 5, or the like, can be reduced a little by the slip ratio of the tires A2, and the differential effect, or the like, in the differential 6 during a steering operation on an irregular road surface.

The controller 7 is composed of, for example, a microcomputer and the like. As described above, the controller 7 receives the speed gear signal FR (specifically, N, F1, F2, F3, R1, R2, or R3) from the speed change lever 41, the operation signal W1 (specifically, Wo, Wd, or Wu) from the arm operation lever 11*a*, the operation signal W3 (specifically, Wo, Wd, or Wu) from the bucket operation lever 11*b*, and the vehicle speed S from the vehicle speed detector 12. When a reference is made to the arm operation lever 11*a* and the bucket operation lever 11*b* collectively, they are simply called "working machine operation levers 11". The controller 7 can input a control signal M into the servo mechanism 811. On receiving the control signal M from the controller 7, the servo mechanism 811 reduces the displacement volume V of the variable displacement hydraulic pump 81 to the minimum side Vmin. When it does not receive the control signal M, the servo mechanism 811 maintains the displacement volume V of the variable displacement hydraulic pump 81 at the maximum side Vmax. The controller 7 previously stores in memory first and second assumption programs and a standard value, in order to output the control signal M to the servo mechanism 811.

(1) The first assumption program is a program in which it is assumed that "the hydraulic working system is in the neutral (non-operating) condition Wo" when both of the operation signals W1 and W3 are "Wo".

(2) The second assumption program is a program in which it is assumed that a situation in which the speed gear signal FR is "F1 or R1" is "a lower side speed gear FRL", while it is assumed that a situation in which the speed gear signal FR is "F2, F3, R2, or R3" is "a higher side speed gear FRH".

(3) The standard value is a specified vehicle speed So (for example, 8 km/h).

In the first embodiment, the first and second assumption programs and the standard value (the vehicle speed detector 12 is used with the standard value as a pair) are summarized, but the controller 7 can previously memorize any one or more of the first assumption program, the second assumption program, and the standard value. When a plurality of them are memorized, it is desirable to prepare a switch or the like (not illustrated) to selectively call one of them.

Accordingly, the controller 7 has the following first to third control programs. Incidentally, the number of main steps in each of the control programs is small; therefore, a flowchart for each control program is omitted.

(1) The first control program uses the first assumption program. Specifically, the controller 7 determines the situation in which both of the operation signal W1 from the arm operation lever 11*a* and the operation signal W3 from the bucket operation lever 11*b* are the neutral position signal Wo (specifically the hydraulic working system is in the neutral (non-operating) condition Wo). When this is determined, the controller 7 inputs the control signal M into the servo mechanism 811. On receiving the control signal M, the servo mechanism 811 shifts the displacement volume V of the variable displacement hydraulic pump 81 from the maximum side Vmax to the minimum side Vmin.

According to the first control program, the following operational effects are obtained. If the first control program were not to exist, the variable displacement hydraulic pump 81 would have the displacement volume V at the maximum side Vmax even if both of the working machine operation levers 11 were to be in their neutral position Wo, and the discharge oil would be drained into the tank 9. At this time, a drain loss or a pump loss is caused by the resistance inside the hydraulic operational valve 10, a conduit, or the like. However, according to the first control program, when both of the working machine operation levers 11 are in their neutral position Wo, the controller 7 reduces the displacement volume V of the variable displacement hydraulic pump 81 to the minimum side Vmin. The same thing happens in a range from a low-to-medium engine speed to a high engine speed of the engine 1; therefore, the excess torque ΔT is increased in a low-to-medium engine speed range, and a hard acceleration performance is increased from a low-to-medium engine speed range to a high engine speed range during traveling. The displacement volume V of the variable displacement hydraulic pump 81 is switched in an on-off step, unlike the prior art which gradually changes between the maximum side Vmax and the minimum side Vmin. For this reason, as soon as the working machine operation levers 11 are operated, the displacement volume V is switched from the minimum side Vmin to the maximum side Vmax. On the other hand, as soon as the working machine operation levers 11 are shifted to their neutral position Wo, the displacement volume V is switched from the maximum side Vmax to the minimum side Vmin. As a result, an extremely quick responsiveness is obtained. Thereby, a higher acceleration and an energy-saving performance, as well as a higher traveling and working efficiency, are obtained.

(2) The second control program uses the second assumption program. Specifically, when the speed gear signal FR from the speed change lever 41 is "F1 or R1" (specifically, a lower side speed gear FRL), the controller 7 does not send the control signal M. Accordingly, the servo mechanism 811 keeps the displacement volume V of the variable displacement hydraulic pump 81 at the maximum side Vmax. On the other hand, when the speed gear signal FR is "F2, F3, R2, or R3" (specifically, a higher side speed gear FRH), the control signal M is inputted to the servo mechanism 811. The servo mechanism 811 receives the control signal M, and promptly reduces the displacement volume V of the variable displacement hydraulic pump 81 in a step fashion to the minimum side Vmin.

According to the second control program, the following operational effect is obtained. When the speed gear signal FR is "F1 or R1", the wheel loader is involved, in most cases, in the combined operation. Accordingly, this can be defined as "the lower side speed gear FRL". On the other hand, when the speed gear signal FR is "F2, F3, R2, or R3", the wheel loader is involved, in most cases, in the sole traveling operation. Accordingly, this can be defined as "the higher side speed gear FRH". Specifically, according to the second control program, when the speed gear FR is a lower side speed gear FRL, it is assumed that the wheel loader is involved in the combined operations; therefore, the displacement volume V of the variable displacement hydraulic pump 81 is increased to the maximum side Vmax, thereby enabling the excavating operation with a high efficiency. On the other hand, when the speed gear FR is a higher side speed gear FRH, it is assumed that the wheel loader is involved in the sole traveling operation; therefore, the displacement volume V of the variable displacement hydraulic pump 81 is reduced to the minimum side Vmin, thereby reducing the drain loss. Specifically, according to the second control program, a higher acceleration and an energy-saving performance, as well as a higher traveling and working efficiency, are also obtained, as in the first control program.

There are various kinds of wheel loaders, but it is suitable if the gears are divided into the "lower side speed gear FRL" and the "higher side speed gear FRH" based on the aforesaid definitions. Accordingly, the assumption program can be a program in which, when the speed gear signal FR is "F1, F2, R1, or R2", it is assumed to be a "lower side speed gear FRL", and when it is "F3 or R3", it is assumed to be a "higher side speed gear FRH". Further, for example, the program can be a program in which, when the speed gear signal FR is "F1, F2, or R1", it is assumed to be a "lower side speed gear FRL", and when it is "F3, R2, or R3", it is assumed to be a "higher side speed gear FRH". The same definition can be applicable for the wheel loader with more or fewer speed gears. A plurality of pairs of "lower side speed gears FRL" and "higher side speed gear FRH" can be prepared at levels different from each other corresponding to the adhesion coefficient of, for example, a rock road surface, an earth road surface, or the like; and a changeover switch or the like can be provided to freely switch and use them.

(3) The third control program uses the vehicle speed detector 12 and a specified vehicle speed So as the standard value (for example, 8 km/h). Specifically, the controller 7 receives the vehicle speed signal S from the vehicle speed detector 12, and when it is determined that the vehicle speed S is less than the specified vehicle speed So (S<So), the controller 7 does not send the control signal M. Accordingly, the servo mechanism 811 keeps the displacement volume V of the variable displacement hydraulic pump 81 at the maximum side Vmax. On the other hand, when it is determined that the vehicle speed S is not less than the specified vehicle speed So (S≧So), the control signal M is inputted to the servo mechanism 811. On receiving the control signal M, the servo mechanism 811 promptly reduces the displacement volume V of the variable displacement hydraulic pump 81 in a stepped fashion to the minimum side Vmin.

According to the third control program, the following operational effect is obtained. First, it is assumed that the specified vehicle speed So expresses the boundary between the definition of "low side speed gear FRL" and the definition of "high side speed gear FRH" in the above second assumption program by means of the vehicle speed. Specifically, when the vehicle speed S is, for example, less than 8 km/h (S<8 km/h), the wheel loader is involved, in most cases, in the combined operations or the sole working operation. On the other hand, when the vehicle speed S is not less than 8 km/h, for example, (S≧8 km/h), the wheel loader is involved, in most cases, in the sole traveling operation. Accordingly, this is defined as "higher side speed gear FRH". Specifically, according to the third control program, a higher acceleration and an energy-saving performance, as well as a higher traveling and working efficiency, are also obtained, as in the second control program. The specified speed So is appropriately set according to the specification (especially the size) of the wheel loader, for example, 8 km/h, 10 km/h, or 15 km/h, or the like. It is also suitable to set a plurality of different specified vehicle speeds So corresponding to the adhesion coefficient of, for example, a rock road surface, an earth road surface, or the like in one wheel loader and to freely switch and use them by means of a changeover switch or the like.

Next, a second embodiment will be explained with reference to FIG. 2. The elements enclosed by a dotted line in FIG. 2 are different as compared with FIG. 1, with the remainder of the elements in FIG. 2 being the same as those in FIG. 1. For this reason, the explanation will be made by mainly comparing the different elements with those in the first embodiment.

Figure 2:
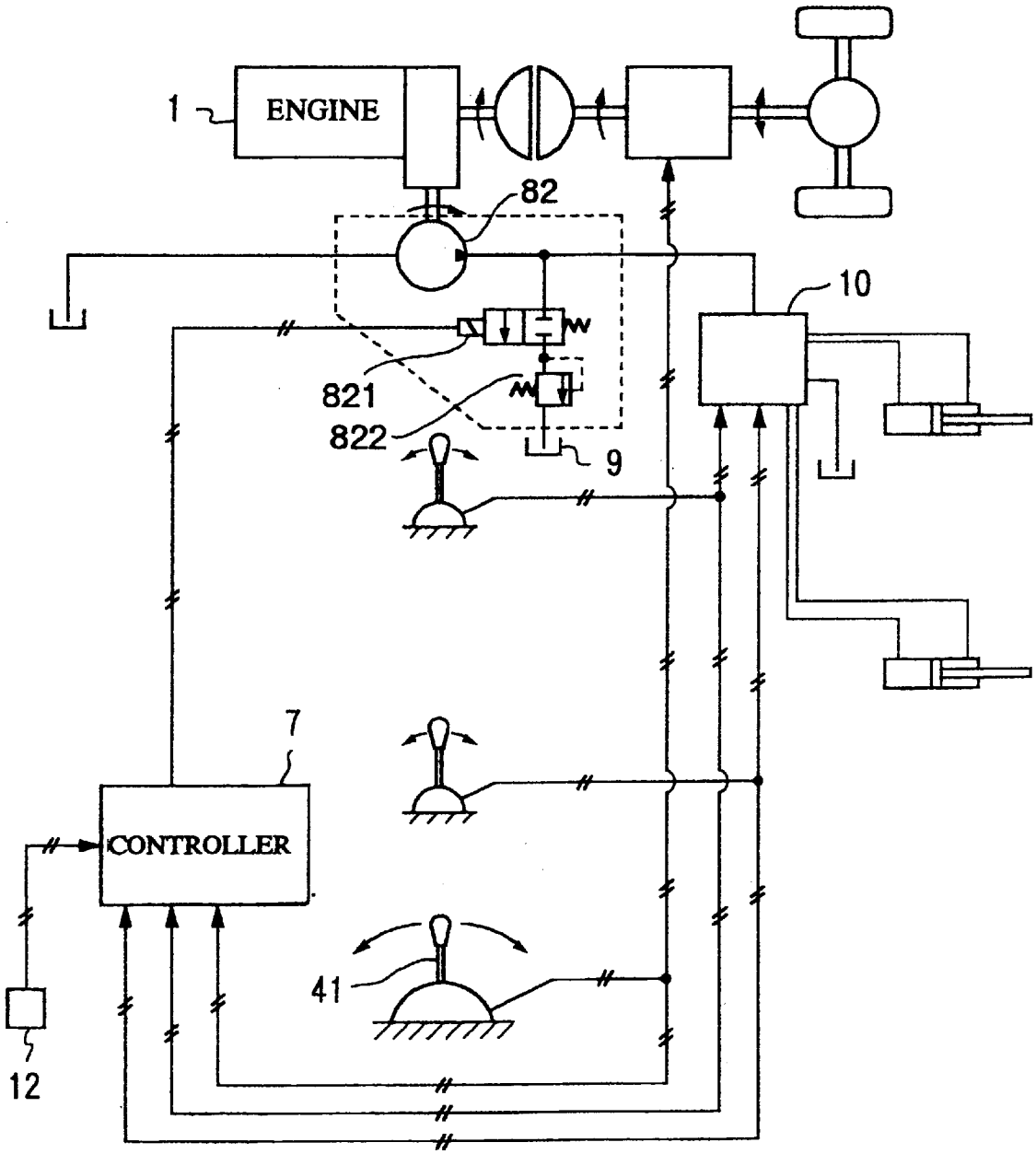
FIG. 2 is a control block diagram according to a second embodiment of the present invention.
Figure 3:
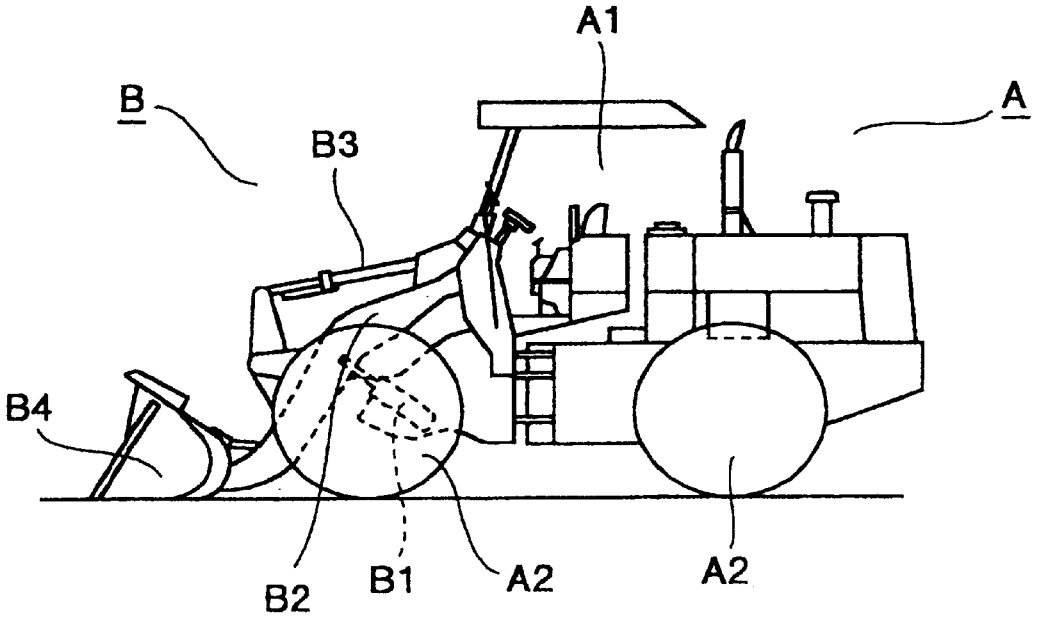
FIG. 3 PRIOR ART
FIG. 3 is a side view of an ordinary wheel loader.

In the second embodiment, as shown in FIG. 2, the variable displacement hydraulic pump 81 in FIG. 1 is replaced by a fixed displacement hydraulic pump 82. Further, the servo mechanism 811 in FIG. 1 is replaced by a solenoid on-off valve 821, which is fluidly connected in parallel with a flow channel from the fixed displacement hydraulic pump 82 to the hydraulic operation valve 10, and an accessory relief valve 822, which is provided at the downstream side of the solenoid on-off valve 821. The accessory relief valve 822 is connected to the tank 9, and is set at 5 kg/cm$^2$, for example. The solenoid on-off valve 821 is a two-position, two-port changeover valve having a cut-off position (the right side position in FIG. 2) and a communicating position (the left side position in FIG. 2). The solenoid on-off valve 821 is normally spring biased to its cut-off position, but when receiving solenoid driving current (the control signal M) from the controller 7, the electromagnetic force opposes the momentum of the spring to thereby switch the valve 821 from its cut-off position to its communicating position. When the solenoid on-off valve 821 is in its communicating position and the fixed displacement hydraulic pump 82 increases the discharge oil pressure to a set oil pressure (5 kg/cm$^2$), the accessory relief valve 822 opens to drain the oil discharge from the fixed displacement hydraulic pump 82 to the tank 9. Specifically, the solenoid on-off valve 821 becomes an unloader valve.

The controller 7 in the second embodiment stores the second assumption program and the specified vehicle speed So, and has the second and third control programs freely switched and used. The situation is just the same as in the first embodiment until the controller 7 sends the control signal M. On receiving the control signal M from the controller 7, the solenoid on-off valve 821 is switched from its cut-off position to its communicating position, and the oil discharged from the fixed displacement hydraulic pump 82 is drained into the tank 9. Accordingly, the entire effect is the same as the respective effects based on the second and the third control programs in the first embodiment.

The accessory relief valve 822 is provided to prevent oil starvation or the like from occurring in the lubrication of the hydraulic operation valve 10 or the like or in the hydraulic operation valve 10 or the like in an unloaded condition. Accordingly, the accessory relief valve 822 can be omitted if the drain line from the solenoid on-off valve 821 to the tank 9 is throttled, if the tank 9 itself is pressurized by a compressed gas, or if the drain line is provided at a portion in the vicinity of the hydraulic operation valve 10, or the like. In a configuration in which oil starvation or the like does not occur in the lubrication of the hydraulic operation valve 10 or the like, or in the hydraulic operation valve 10 or the like in an unloaded condition, the accessory relief valve 822 and the like can be eliminated.

In both illustrated embodiments of the invention, the hydraulic working system is operated by receiving a useful output of a hydraulic pump. The useful output can be pressurized oil discharged from a variable displacement hydraulic pump, or the useful output can be pressurized oil from a combination of a fixed displacement hydraulic pump and an unloader valve, wherein in its communicating state the unloader valve drains part of the pressurized oil from the fixed displacement hydraulic pump into a sump tank. In other words, the pressurized oil which is discharged by the fixed displacement hydraulic pump and which is not drained via the unloader valve to the sump tank constitutes the useful output of the combination.

In both illustrated embodiments of the invention, the useful output of the pump can be controlled responsive to whether a speed related variable is a first condition or a second condition. The speed related variable can be the identity of the speed gear which is being used, with the first condition being when the speed gear being used is a lower side speed gear, and with the second condition being when the speed gear being used is a higher side speed gear. Similarly, the speed related variable can be the vehicle speed, with the first condition being when the vehicle speed is less than a specified vehicle traveling speed, and with the second condition being when the vehicle speed is not less than the specified vehicle traveling speed.

Reasonable variation and modifications are possible within the scope of the foregoing description, the drawings and the appended claims to the invention.

That which is claimed is:

1. A wheel loader comprising:

a vehicle body;

a traveling system, which includes an engine as a driving power source;

a hydraulic pump having said engine as a driving power source;

a bucket moveably attached to said vehicle body;

at least one arm hydraulic cylinder for raising and lowering said bucket;

a bucket hydraulic cylinder for tilting said bucket, said arm hydraulic cylinder and said bucket hydraulic cylinder comprising a hydraulic working system, which is operated by receiving pressurized oil from said hydraulic pump; and control means for controlling a useful output of said hydraulic pump to said hydraulic working system to be at a maximum when a speed related variable of said traveling system is a first condition and to be at a minimum when the speed related variable of said traveling system is a second condition.

2. A wheel loader in accordance with claim 1, wherein said hydraulic pump is a variable displacement hydraulic pump which has a displacement volume; wherein said control means comprises:

a controller; and a vehicle speed detecting means for detecting, as the speed related variable, a traveling speed of said wheel loader;

wherein said controller inputs from said vehicle speed detecting means a signal representing a thus detected traveling speed; and wherein said controller controls the displacement volume of said hydraulic pump to be at a maximum when the thus detected traveling speed is less than a specified vehicle speed, and controls the displacement volume to be at a minimum when the thus detected traveling speed is not less than the specified vehicle speed.

3. A wheel loader in accordance with claim 2, wherein said controller promptly changes the displacement volume in a step fashion to be at a minimum when the thus detected vehicle speed changes from being less than said specified vehicle speed to being not less than said specified vehicle speed.

4. A wheel loader in accordance with claim 1, wherein said hydraulic pump is a combination of a fixed displacement hydraulic pump and an unloader valve; wherein in a communicating state the unloader valve drains pressurized oil from said fixed displacement hydraulic pump into a tank;

wherein pressurized oil which is discharged by said fixed displacement hydraulic pump and which is not drained via said unloader valve to the tank constitutes useful output of the combination; wherein said traveling system has a plurality of speed gears, which can be selectively used, said plurality of speed gears including at least one lower side speed gear and at least one higher side speed gear; and wherein said control means comprises:

a controller; and a vehicle speed detecting means for detecting, as the speed related variable, a traveling speed of said wheel loader;

wherein said controller inputs from said vehicle speed detecting means a signal representing a thus detected traveling speed; and wherein said controller controls the unloader valve so that the useful output of the combination is at a maximum when the thus detected traveling speed is less than a specified vehicle speed, and controls the unloader valve so that the useful output is at a minimum when the thus detected traveling speed is not less than the specified vehicle speed.

5. A wheel loader in accordance with claim 4, further comprising a pressure relief valve connected in series between said unloader valve and said tank.

6. A wheel loader in accordance with claim 4, wherein said controller promptly controls the unloader valve in a step fashion so that the useful output of the combination is at a minimum when the thus detected speed gear changes from the lower side speed gear to the higher side speed gear.

7. A wheel loader comprising:

a traveling system, which includes an engine as a driving power source;

a hydraulic pump having said engine as a driving power source, wherein said hydraulic pump is a variable displacement hydraulic pump which has a displacement volume; wherein said traveling system has a plurality of speed gears, which can be selectively used, said plurality of speed gears including at least one lower side speed gear and at least one higher side speed gear;

a hydraulic working system, which is operated by receiving pressurized oil from said hydraulic pump; and control means for controlling a useful output of said hydraulic pump, said control means including a controller and a speed gear detecting means for detecting one of said plurality of speed gears which is being used;

wherein said controller inputs from said speed gear detecting means a signal representing a thus detected speed gear; and wherein said controller controls the displacement volume of said hydraulic pump to be at a maximum when the thus detected speed gear is the lower side speed gear, and controls the displacement volume to be at a minimum when the thus detected speed gear is the higher side speed gear.

8. A wheel loader in accordance with claim 7, wherein said controller promptly changes the displacement volume to be at the minimum when the thus detected speed gear changes from the lower side speed gear to the higher side speed gear.

9. A wheel loader comprising:

a traveling system, which includes an engine as a driving power source, said traveling system having a plurality of speed gears, which can be selectively used, said plurality of speed gears including at least one lower side speed gear and at least one higher side speed gear;

a hydraulic pump having said engine as a driving power source, said hydraulic pump being a combination of a fixed displacement hydraulic pump and an unloader valve; wherein in a communicating state the unloader valve drains pressurized oil from said fixed displacement hydraulic pump into a tank; wherein pressurized oil which is discharged by said fixed displacement hydraulic pump and which is not drained via said unloader valve to the tank constitutes useful output of the combination;

a hydraulic working system, which is operated by receiving pressurized oil from said hydraulic pump; and control means for controlling the useful output of said hydraulic pump, said control means including a controller and a speed gear detecting means for detecting one of said plurality of speed gears which is being used;

wherein said controller inputs from said speed gear detecting means a signal representing a thus detected speed gear; and wherein said controller controls the unloader valve so that the useful output of the combination is at a maximum when the thus detected speed gear is the lower side speed gear, and controls the unloader valve so that the useful output is at a minimum when the thus detected speed gear is the higher side speed gear.

10. A wheel loader in accordance with claim 9, further comprising a pressure relief valve connected in series between said unloader valve and said tank.

11. A wheel loader in accordance with claim 9, wherein said controller promptly controls the unloader valve in a step fashion so that the useful output of the combination is at a minimum when the thus detected speed gear changes from the lower side speed gear to the higher side speed gear.

* * * * *